US009186784B2

(12) United States Patent
Persson et al.

(10) Patent No.: US 9,186,784 B2
(45) Date of Patent: Nov. 17, 2015

(54) POWER WRENCH WITH A TORQUE SENSING UNIT

(75) Inventors: Erik Vilhelm Persson, Solna (SE); Ulf Roland Brändström, Bagarmossen (SE); John Berglind, Tyreso (SE); Martin Hertsius, Bromma (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 223 days.

(21) Appl. No.: 14/111,154

(22) PCT Filed: May 3, 2012

(86) PCT No.: PCT/EP2012/058133

§ 371 (c)(1),
(2), (4) Date: Oct. 10, 2013

(87) PCT Pub. No.: WO2012/150303

PCT Pub. Date: Nov. 8, 2012

(65) Prior Publication Data

US 2014/0026723 A1 Jan. 30, 2014

(30) Foreign Application Priority Data

May 4, 2011 (SE) ..... 1150390

(51) Int. Cl.
*B25B 23/14* (2006.01)
*B25B 21/00* (2006.01)
*B25B 23/147* (2006.01)

(52) U.S. Cl.
CPC ..... *B25B 23/14* (2013.01); *B25B 21/00* (2013.01); *B25B 23/147* (2013.01)

(58) Field of Classification Search
CPC .. B25B 23/14; B25B 23/142; B25B 23/1425; B25B 23/1456; B25B 23/147; B25B 21/00
See application file for complete search history.

(56) References Cited

U.S. PATENT DOCUMENTS

| | | | | |
|---|---|---|---|---|
| 4,404,799 | A | 9/1983 | Dudek | |
| 9,016,398 | B2 * | 4/2015 | Steckel et al. | 173/181 |
| 2011/0000694 | A1 | 1/2011 | Hansson et al. | |
| 2014/0011621 | A1 * | 1/2014 | Steckel et al. | 475/149 |

FOREIGN PATENT DOCUMENTS

| | | | |
|---|---|---|---|
| WO | WO 2008/090069 | A1 | 7/2008 |
| WO | WO 2009/005435 | A1 | 1/2009 |

OTHER PUBLICATIONS

International Search Report (ISR) dated Jul. 3, 2012 (in English) issued in International Application No. PCT/EP2012/058133.

* cited by examiner

*Primary Examiner* — David B Thomas
(74) *Attorney, Agent, or Firm* — Holtz, Holtz, Goodman & Chick PC

(57) ABSTRACT

A power wrench with a torque sensing unit includes a housing, a motor, an output shaft, and a planetary reduction gearing connecting the motor to the output shaft and including a stationary ring gear supported in the housing, wherein the torque sensing unit includes a torque transferring element with a single radially extending reaction arm arranged to transfer reaction torque from the ring gear to the housing and carrying strain measuring sensors for generating signals in response to the transferred reaction torque. The torque transferring element includes an annular body with two weak portions to be elastically deformed during torque transfer and having flat surfaces for carrying the strain measuring sensors.

9 Claims, 1 Drawing Sheet

POWER WRENCH WITH A TORQUE SENSING UNIT

The invention relates to a power wrench having a torque sensing unit for generating electric signals in response to the actually delivered output torque.

In particular, the invention concerns a power tool comprising a housing, a motor, an output shaft, and a planetary type reduction gearing connecting the motor to the output shaft and including a stationary ring gear supported in the housing. The ring gear is arranged to transfer the reaction torque from the gearing to the housing, wherein the reaction torque in the ring gear corresponds to the output torque delivered through the output shaft.

A power wrench of this type is previously described in U.S. Pat. No. 4,404,799, wherein the ring gear is secured to the wrench housing via a weak neck portion provided with strain gauges. During torque transmission through the gearing the weak portion yields elastically to the reaction torque, and the delivered output torque is measured as a deformation of this weak neck portion of the ring gear which corresponds to the output torque. However, this prior art device is disadvantageous in that the described ring gear arrangement is rather bulky, particularly as regards its axial extension which influences negatively on the outer dimensions of the power wrench.

A more compact torque sensor design is described in Swedish patent application 0701621-5. The power wrench described therein is provided with a torque sensing unit comprising an annular torque transferring element provided with strain gauges and arranged to transfer reaction torque from a ring gear of a planetary gearing to the wrench housing. This torque sensing unit is very compact in the axial direction and does not add to the length of the power wrench.

In WO 2008/090069 there is also described a compact torque sensing unit which is intended to engage both a ring gear of a planetary reduction gearing and the power wrench housing so as to transfer a reaction torque from the ring gear to the housing. This torque sensing unit comprises a sensor body having two pairs of laterally extending arms, whereof one pair is intended to engage the housing and the other pair is locked to the ring gear. The first pair of arms carries a number of strain gauges to generate signals in response to elastic yielding of the sensing arms in response to the transferred reaction torque.

Both of the above described prior art torque sensing arrangements are suffering from a serious drawback, namely that they are connected to the ring gear and the housing in four points, which means that occurring scattering in tolerances at manufacturing of the power wrench parts as well as the sensor element itself inevitably creates differences in the load levels on the individual arms. This results in undesirable tolerance related variations and uncertainties in the signals generated by the strain gauges as a measure on the reaction torque transferred between the ring gear and the housing and, hence, a measure on the delivered output torque from the power wrench.

The above problem is solved by the invention in that the power wrench is provided with a torque sensing unit wherein the reaction torque transferred from the ring gear to the housing is always measured in a correct way independently of the tolerance scattering on the power wrench parts and/or the torque transferring element itself.

According to a main aspect the invention relates to a power wrench with a torque sensing unit, comprising a housing, a motor, an output shaft, and a planetary reduction gearing connecting the motor to the output shaft and including a stationary ring gear supported in the housing, wherein the torque sensing unit comprises a torque transferring element arranged to transfer reaction torque from the ring gear to the housing and carrying a strain measuring sensors arranged to generate electric signals in response to the magnitude of the transferred reaction torque. The torque transferring element comprises an annular body with an outer diameter substantially equal to the inner diameter of the ring gear and having at its outer periphery a number of teeth matching and engaging the teeth of the ring gear to thereby rotationally lock the torque transferring element to the ring gear, and said torque transferring element comprises a single reaction arm extending radially from the annular body and arranged to engage an abutment on the housing.

In a specific embodiment of the invention the teeth are provided in a sector A of the outer periphery of said annular body, said sector A being located diametrically opposite said reaction arm. The sector A may also be divided into a plurality of smaller sectors, wherein in reality no sector is located precisely opposite to the reaction arm.

In another embodiment of the invention said sector A, or sectors, extend(s) over at least 180 degrees of the periphery of said annular body. The extension of 180 degrees also includes interspaces, if any, between the individual sectors, such that the sum of toothed sectors may be far less than 180 degrees.

In yet another embodiment of the invention said annular body comprises at least one weak portion with a flat surface for carrying the strain measuring means, wherein said flat surface is located in a plane parallel to a geometric axis of the ring gear.

In a specific embodiment of the invention said annular body comprises two weak portions that are located at opposite sides of said reaction arm.

The torque sensing unit according to the invention is advantageous in that it is simple in design and relatively cheap to manufacture.

A preferred embodiment of the invention is described below with reference to the accompanying drawings.

In the drawings

Figure 1:
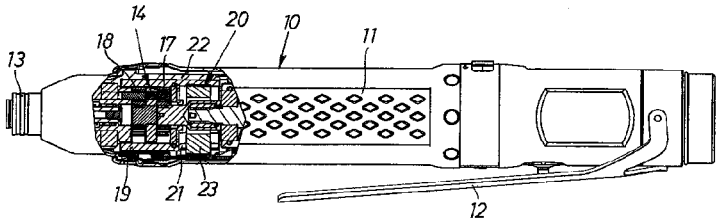
FIG. 1 shows a side view, partly in section, of a power wrench according to the invention.
Figure 2:
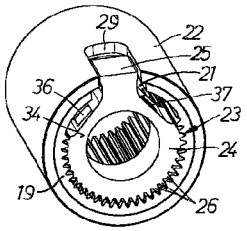
FIG. 2 shows a perspective view of the torque sensing unit according to the invention.
Figure 3:
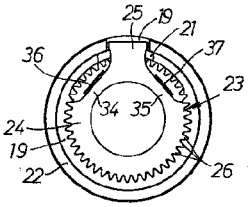
FIG. 3 shows a rear end view of the torque sensing unit in FIG. 2.
Figure 4:
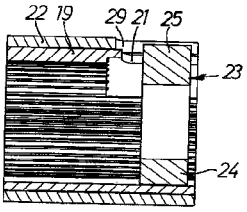
FIG. 4 shows a longitudinal section through the torque sensing unit.
Figure 5:
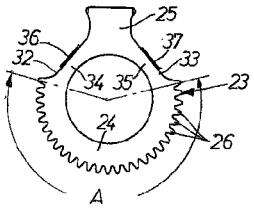
FIG. 5 shows an end view of the torque transferring element.
Figure 6:
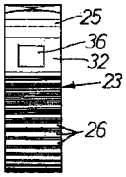
FIG. 6 shows a side view of the torque transferring element.

The power wrench illustrated in the drawings comprises a housing 10 with a rear handle 11 and a power control lever 12, a rotation motor, an output shaft 13, and a reduction gearing 14 connecting the motor to the output shaft 13. The reduction gearing 14 is of a well known planetary type and comprises in the illustrated example two stages 17,18 with a common ring gear 19. The latter is sleeve shaped extends axially beyond the gearing stages 17,18 and is provided with a lateral gap 21. The ring gear 19 is supported in an inner sleeve 22 which is rigidly secured in the housing 10.

A torque sensing unit 20 is provided between the ring gear 19 and the housing 10 and arranged to indicate the reaction torque generated in the ring gear 19 during power wrench operation. The torque sensing unit 20 comprises a torque transferring element 23 which is provided inside the ring gear 19 and arranged to transfer the reaction torque from the reduction gearing 14 to the housing 10 and at the same time retain the ring gear 19 against rotation. The torque transferring element 23 comprises an annular body 24 and a radially extending reaction arm 25, wherein the annular body 24 is provided on its outer periphery with a number of teeth 26 which are adapted to match and engage the teeth of the ring gear 19. These teeth 26 are covering a certain sector A of the ring gear outer periphery, and diametrically opposite that sector A there is the radially extending reaction arm 25. The latter extends out through the lateral gap 21 in the ring gear 19 and engages by its outer end portion the edges of a slot 29 in the inner sleeve 22 of the housing 10 to thereby take support against rotation. During power wrench operation the reaction torque acting on the ring gear 19 is transferred to the housing 10 via the reaction arm 25 on the torque transferring element 23 and the inner sleeve 22.

The torque transferring element 23 also comprises two flat surfaces 32,33 which are located on two transition portions 34,35 of the annular body 24 connecting the latter to the reaction arm 25. These transition portions 34,35 have a somewhat weaker cross section than the reaction arm 25 and are intended to yield elastically to the bending forces in the reaction arm 25 resulting from the reaction torque transfer from the ring gear 19 to the housing 10.

On the two flat surfaces 32,33 of the transition portions 34,35 there are mounted strain measuring sensors 36,37 which are intended to generate electric signals in response to the bending forces on the reaction arm 25 caused by the reaction torque in the ring gear 19. The strain gauges 36,37 are connected via a non-illustrated wiring to an operation control unit in the housing 10, whereby the electric signals indicate the actually delivered output torque on the output shaft 13.

The invention claimed is:

1. A power wrench with a torque sensing unit, comprising a housing, a motor, an output shaft, and a planetary reduction gearing connecting the motor to the output shaft and including a stationary ring gear supported in the housing, wherein the torque sensing unit comprises a torque transferring element arranged to transfer reaction torque from the ring gear to the housing and carrying a strain measuring sensor arranged to generate electric signals in response to the magnitude of the transferred reaction torque, wherein:

the torque transferring element comprises an annular body with an outer diameter equal to the inner diameter of the ring gear and having at an outer periphery a number of teeth matching and engaging teeth of the ring gear to thereby rotationally lock the torque transferring element to the ring gear, and said torque transferring element comprises a single reaction arm extending radially from the annular body and arranged to engage an abutment on the housing.

2. The power wrench according to claim 1, wherein said teeth are provided in a sector of the outer periphery of said annular body, said sector being located diametrically opposite said reaction arm.

3. The power wrench according to claim 2, wherein said sector extends over at least 180 degrees of the periphery of said annular body.

4. The power wrench according to claim 3, wherein said annular body comprises at least one weak portion with a flat surface for carrying the strain measuring means, and wherein said flat surface is located in a plane parallel to a geometric axis of the ring gear.

5. The power wrench according to claim 4, wherein said annular body comprises two weak portions located at opposite sides of said reaction arm.

6. The power wrench according to claim 2, wherein said annular body comprises at least one weak portion with a flat surface for carrying the strain measuring means, and wherein said flat surface is located in a plane parallel to a geometric axis of the ring gear.

7. The power wrench according to claim 6, wherein said annular body comprises two weak portions located at opposite sides of said reaction arm.

8. The power wrench according to claim 1, wherein said annular body comprises at least one weak portion with a flat surface for carrying the strain measuring means, and wherein said flat surface is located in a plane parallel to a geometric axis of the ring gear.

9. The power wrench according to claim 8, wherein said annular body comprises two weak portions that are located at opposite sides of said reaction arm.

* * * * *